US005493080A

United States Patent [19]

Moss

[11] Patent Number: 5,493,080

[45] Date of Patent: Feb. 20, 1996

[54] EXTERNAL ARRANGEMENT FOR DAMPING SOUNDS IN A PIPE SYSTEM

[75] Inventor: Hans Moss, Veldhoven, Netherlands

[73] Assignee: AB Volvo, Göteborg, Sweden

[21] Appl. No.: 298,978

[22] Filed: Sep. 2, 1994

[30] Foreign Application Priority Data

Mar. 5, 1993 [SE] Sweden ..... 9300732-6

[51] Int. Cl.[6] ..... F01N 7/02

[52] U.S. Cl. ..... 181/232; 181/227; 181/250

[58] Field of Search ..... 181/227, 228, 181/232, 250, 255, 258, 282

[56] References Cited

U.S. PATENT DOCUMENTS

| | | | |
|---|---|---|---|
| 2,297,046 | 9/1942 | Bourne | 181/250 |
| 3,396,812 | 8/1968 | Wilcox et al. | 181/227 |
| 3,612,217 | 10/1971 | Heath | 181/227 |
| 3,776,364 | 12/1973 | Van Doeren | 181/250 |
| 5,245,140 | 9/1993 | Wu | 181/232 |

FOREIGN PATENT DOCUMENTS

| | | |
|---|---|---|
| 739460 | 8/1943 | Germany . |
| 2022851 | 11/1971 | Germany . |
| 2-153212 | 6/1990 | Japan . |

*Primary Examiner*—Khanh Dang

*Attorney, Agent, or Firm*—Burns, Doane, Swecker & Mathis

[57] ABSTRACT

A device for sound suppression in a channel system for flowing gases or air, particularly an exhaust system or intake system in an internal combustion engine, includes at least one channel which is in communication with two volumes or apertures, wherein standing sound waves arise in the channel. One of the two volumes or apertures can be in the form of a main silencer or a filter housing while the other volume of aperture is in the form of a smaller silencer or an inlet pipe. The pipe, which may be in the form of a volume space, has one end, an inlet opening, in acoustical communication with the channel, while an opposite end is wholly or partly closed against the environment. The pipe is located outside the channel and an acoustic permeable filter is provided in the region near the inlet opening of the pipe. The filter has a flow resistance within the interval 5 $Ns/m^3$–2000 $Ns/m^3$, preferably within the interval 30–300 $Ns/m^3$.

20 Claims, 1 Drawing Sheet

EXTERNAL ARRANGEMENT FOR DAMPING SOUNDS IN A PIPE SYSTEM

FIELD OF THE INVENTION

The present invention pertains to a broad band operating device for sound suppression of channel systems. In particular, the present invention relates to an externally located broad band operating device for sound suppression of channel systems of internal combustion engines.

BACKGROUND OF THE INVENTION

Swedish Patent Application No. 9103522-0 describes an internally located device for sound suppression of a channel system, particularly for an exhaust system of internal combustion engines.

A channel system that is connected to a disturbance sound source, for instance an intake system for internal combustion engines, generally consists of an air filter housing as well as a channel positioned before and after the air filter housing. The channel disposed after the air filter housing has its other end connected to the inlet manifold of the engine so that the channel disposed after the air filter housing constitutes a channel for conveying the filter purified air to the engine. In this type of system, the cross sectional area of the inlet manifold is considerably larger than that of the air channel. The above-described system has, from an acoustic point of view, an equivalent in an exhaust system. That is, there is to be found at least one channel or tube, both ends of which are coupled to volumes or spaces constituting silencers. The last channel of the exhaust system as seen in the flow direction has one end coupled to the environment or outside atmosphere which constitutes an infinite volume.

For an inlet system or an exhaust system constructed according to the above description, so-called standing sound waves arise in the channel between the two volumes or spaces. At these resonance frequencies, the so-called insertion damping is very low, or sometimes even negative. That is, pulse sounds from valve openings pass out through the system with very low sound suppression—or sometimes even as an amplified sound.

The first standing sound wave, the so-called "lambda half" ($\lambda/2$), has its maximum sound pressure midway between both channel ends and its maximum velocity at both respective ends. Multiples of $\lambda/2$, for example $\lambda$ or $1.5\lambda$, have 2 and 3 sound pressure maxima respectively between the ends of the channel. One of these velocity maxima is located at the respective channel ends. The frequency of these standing waves is determined by the channel length and the gas temperature. The gas temperature dependence means that the frequency, i.e., the resonance amplifications, varies strongly between a hot system and a cold system, which is the case, for example, in an exhaust system.

In U.S. Pat. Nos. 3,396,812 and 3,415,338, so-called quarter wave pipes are used to reduce standing waves in an exhaust system. These solution alternatives have the common drawback that the temperature in quarter wave pipes normally differs significantly from the temperature in the exhaust system channel which may vary between ambient temperature in a cold engine to 600°–700° C. at full load. This means that the constant length of the quarter wave pipes corresponds to any of $\lambda/2$, $\lambda$, $1.5\lambda$, etc. in the exhaust channel only within a very limited exhaust gas temperature range.

Since the so-called quarter wave pipe of traditional form has a very narrow band suppression characteristic, the solutions mentioned above also exhibit great limitations in connection with inlet systems in which the temperature variations are considerably lower. For a 2 liter petrol engine, the flow velocity in the filter channel between the filter housing and the inlet manifold is up to about 25 m/s at full load and 5000 rpm. During motor braking, i.e., a closed throttle condition, the flow velocity is almost 0 m/s. The flow differences between about 0 m/s and 25 m/s implies that the so-called acoustic impedance in the region of the inlet to the quarter wave pipe coupled to the system channel varies significantly. The narrow band characteristic of the quarter wave pipe in combination with variations in its inlet impedance means that maximum frequency adaption must be made very carefully and even in spite of this, cannot be optimized for all cases of motor operation.

Further, great drawbacks in traditional forms of quarter wave pipes are their side band affects. That is, if optimum adaptation/suppression has been achieved for example for $\lambda/2$, interference inevitably is obtained above as well as below the frequency which corresponds to $\lambda/2$. For instance, if the cross sectional area of the quarter wave pipe is equal to that of the channel where $\lambda/2$ arises, the amplifications are obtained by a known method at about 0.7 and 1.4 times the original resonance frequency respectively. If, for example in 5-cylinder engines, sound suppression is wished at a standing wave caused by a second multiple of the ignition frequencies, as a result of the side band effect a strong amplification is obtained instead of the third multiple of the ignition frequency. This occurs at the same number of revolutions as the original problem.

OBJECTS AND SUMMARY OF THE INVENTION

An object of the invention is to achieve a sound suppression device for exhaust and/or inlet channels which in an efficient and inexpensive way provides a sufficient broad band sound suppression of selected frequency ranges. This should preferably be carried out with minimal side band amplifications.

An additional object is to diminish the dependence of the device on the engine load related temperature and/or acoustic impedance variations that arise in the exhaust or inlet channel.

The present invention involves a further development with respect to the device described in the aforementioned Swedish Patent Application No. 9103522-0. More particularly, the present invention involves a so-called quarter wave pipe and/or a so-called Helmholtz resonator which externally operates with a main channel system, wherein the elements are intended to create a substantial sound suppression within a broad frequency band for that standing wave(s) which arises within the main channel system. The device includes at least one channel, the ends of which communicate with a volume space or opening, for instance in the form of a silencer and a channel outlet, in such a way that at least one standing sound wave can arise in the channel.

BRIEF DESCRIPTION OF THE DRAWING FIGURES

The foregoing features of the present invention and others will become more apparent from the detailed description of the invention set forth below considered in conjunction with the accompanying drawing figures in which like elements bear like reference numerals and wherein.

DETAILED DESCRIPTION OF THE PREFERRED EMBODIMENTS

Figure 1:
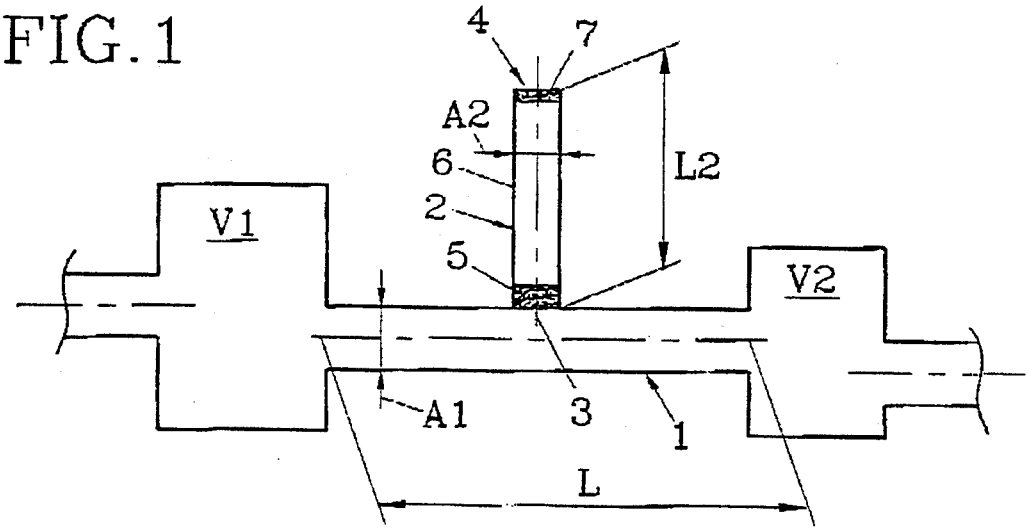
FIG. 1 is a diagrammatic illustration of a section of an exhaust system or intake system which includes a suppression device according to the invention.

The exhaust or intake system shown in FIG. 1 includes a channel 1, a volume or space V1, and an additional yet smaller volume or space V2. In an exhaust system, the volume V1 constitutes the main silencer while the volume V2 constitutes a second smaller silencer. In an intake system, the volume V1 constitutes the filter housing while the volume V2 constitutes the inlet pipe or manifold. Between the two volumes at the distance L, one or more standing sound waves may arise in a way described earlier. The maximum sound pressure for the first standing wave ($\lambda/2$) arises in the region about L/2, and for the second standing wave $\lambda$ in the regions L/3 and 2L/3 respectively.

The system also includes a pipe 2 having a length L2 that is at least 0.75 times, preferably at least 0.9 times, the half length L of the channel. The inlet 3 of the pipe 2 is placed within the acoustic maximum pressure range at L=L/2. The pipe 2 is provided with an end plate 4 that constitutes a reflection element for the standing wave formed in the pipe 2 which has the shape of a quarter wave length, with the maximum pressure at the end plate 4 and the maximum particle velocity at the inlet 3.

In the region of maximum particle velocity at the inlet 3, an acoustic filter 5 is mounted. The filter 5 is advantageous if the ratio of the cross sectional areas A2/A1 is larger than in traditional quarter wave pipes. The cross sectional area A2 should, therefore, be greater than 0.1 times A1, preferably substantially greater, for instance at least 0.4 times A1. The resistive losses of the filter 5, the so-called flow resistance, is carefully selected based on the degree of required sound suppression, and based on what can be accepted as side band amplifications, on a practically available ratio of A2/A1, on available length L2 and on accessibility of location along length L of the channel.

The flow resistance of the filter 5 should be within the interval 5 $Ns/m^3$–2000 $Ns/m^3$, but preferably within the interval 30 $Ns/m^3$–300 $Ns/m^3$. The filter 5 should be placed at a distance at least 0.6 times, preferably at least 0.9 times, the distance L from the end plate 4.

With the above specification of the invention sufficient sound suppression is obtained for the selected standing wave, resonance, in the channel 1. This is achieved without appreciable side band amplifications. A so-called side resonator in the form of the quarter wave pipe 2 is considerably simpler to adapt than traditional ones, at least when considering the accessibility of its location, its length L2, its A2/A1-ratio, etc. As can be appreciated, modern vehicles of today have considerable limitations in the motor compartment which is already crammed.

For purposes of obtaining more control parameters, for instance when an intake system is going to be used for several different motor versions, well tested leakage flows within the mantle 6 of the pipe 2 and/or the end plate 4 can be combined with the filter 5. A leakage filter 7 can be provided which, irrespective of propagation area, can be given a very limited permeability, or more exactly less than 1% of the area A1. The most simple design of the leakage filter 7 can be constituted by one or several small holes. The diameter of the holes may suitably be 2–5 mm.

Figure 2:
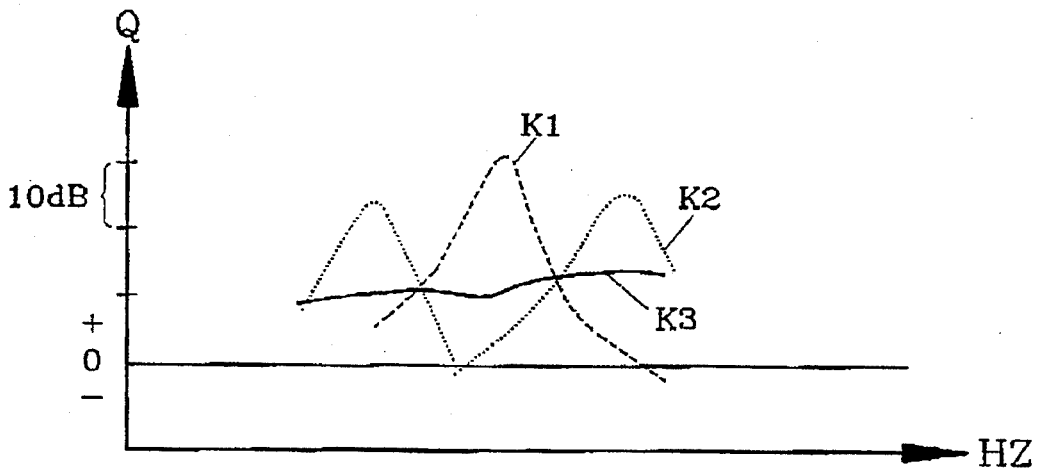
FIG. 2 is a graph illustrating the suppression characteristics associated with the device of the present invention.

FIG. 2 shows diagrammatically and graphically the object of the invention. In the channel 1, a standing wave (i.e., a resonance) arises. This resonance is suppressed quite little and the amplification Q frequently corresponds to about 30 db as shown with respect to curve K1. With a quarter wave pipe of traditional form, this resonance can be more or less eliminated. However, for the unsuppressed quarter wave pipe of traditional form, the side band affects become evident as seen with respect to curve K2. The schematic amplification of a quarter wave pipe according to the invention appears from the curve K3. The degree of amplification, that is the curve shape, depends on the degree of adaption. Tests have been carried out with a filter characteristic of 100 $Ns/m^3$ and a ratio A2/A1=0.3. The tests show that more than 15 db suppression of the original resonance is possible without the side band amplifications practically appearing. This is very satisfactory.

Figure 3:
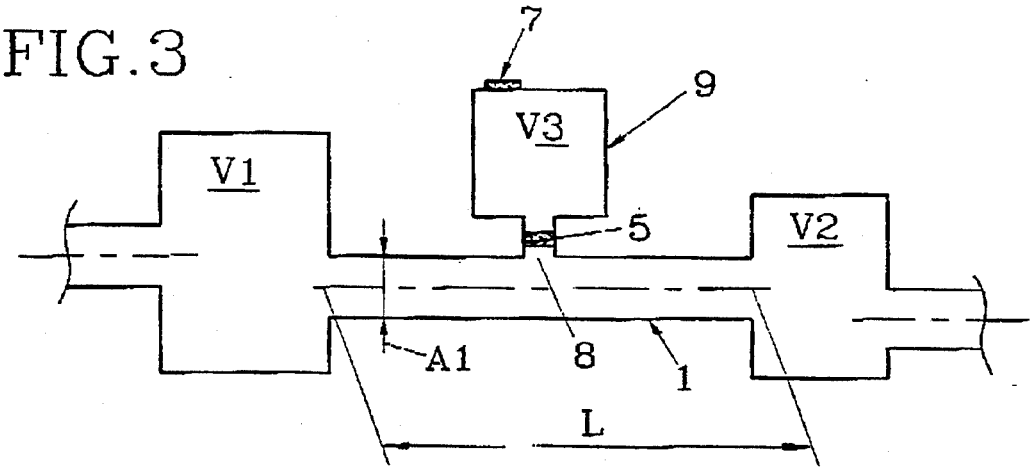
FIG. 3 is a diagrammatic illustration of a section of an exhaust system or intake system which includes a suppression device according to an alternative embodiment of the invention.

A further embodiment of the device according to the invention is illustrated in FIG. 3. At this side resonator, the insertion damping is dimensioned according to known art for a side resonator of the Helmholtz resonator type. That is, the volume V3 is adapted to the dimension of the throat 8 and to the temperature in question. With the corresponding purpose as above, a filter element 5 advantageously is inserted in the neck 8. Further the volume space V3 can be provided with a leakage filter 7. Also, this embodiment can be combined with the pipe 2. The filter 5 and/or the leakage filter 7 can be made of traditional glasswool alternatively sinter or glass wool inserts. If normal glass wool discs (having a specific flow resistance of about 50 $kNs/m^4$ per thickness 50 mm) are used, the thickness of the filter can be limited to 2–3 mm.

It is to be understood that the invention is not limited to the embodiments described above and illustrated in the drawing figures. For instance, the pipe 2 may wholly or partly surround the channel 1 in such a way as to constitute an envelope surface to the channel 1. Thus, it is to be recognized that variations and changes may be made by others, and equivalents employed, without departing from the spirit and scope of the invention as defined by the appended claims. Accordingly, it is expressly intended that all such changes, variations and equivalents which fall within the scope of the claims be embraced thereby.

What is claimed is:

1. Device for sound suppression in a channel system for flowing gases or air such as an exhaust system or intake system of an internal combustion engine, comprising at least one channel which communicates with two volumes in such a way that standing sound waves arise in the channel between the two volumes, a pipe located outside the channel and having one end acoustically communicating with said channel and an opposite end at least partly closed from the outside environment, and an acoustically permeable filter provided adjacent the one end of the pipe, said filter having a flow resistance within a range of 5 $Ns/m^3$–2000 $Ns/m^3$.

2. Device according to claim 1, wherein said pipe is a volume space having a throat connected to the channel.

3. Device according to claim 2, wherein the throat is arranged adjacent a region of the channel at which sound pressure is a maximum.

4. Device according to claim 2, wherein the volume space is provided with a leakage filter with a limited sound or gas permeability, a total permeability area of the leakage filter being less than 1% of a flow through area of the channel.

5. Device according to claim 1, wherein said channel has a cross sectional area, said pipe having a cross sectional area that is greater than 0.1 times the cross sectional area of the channel.

6. Device according to claim 1, wherein said pipe has a cross sectional area that is greater than 0.4 times the cross sectional area of the channel.

7. Device according to claim 1, wherein the pipe is provided with an end plate which has limited gas or sound permeability.

8. Device according to claim 1, wherein the pipe is provided with a mantle which has limited gas or sound permeability.

9. Device according to claim 1, wherein the pipe is provided with a leakage filter with a limited sound or gas permeability, a total permeability area of the leakage filter being less than 1% of a flow through area of the channel.

10. Device according to claim 1, wherein the channel has a half length and the pipe has a length of at least 0.75 of the half length of the channel.

11. Device according to claim 1, wherein the channel has a half length and the pipe has a length of at least 0.90 of the half length of the channel.

12. Device according to claim 1, wherein the filter is arranged within the pipe at a distance of at least 0.6 times the length of the pipe.

13. Device according to claim 1, wherein the filter is arranged within the pipe at a distance of at least 0.9 times the length of the pipe.

14. Device according to claim 1, wherein the pipe is arranged adjacent a region of the channel at which sound pressure is a maximum.

15. Device according to claim 1, wherein said filter has a flow resistance in the range of 30 $Ns/m^3$–300 $Ns/m^3$.

16. Device according to claim 1, wherein said channel has a length L, said pipe being arranged at 0.5 L.

17. Device according to claim 1, wherein said channel has a length L, said pipe being arranged at L/3.

18. Device according to claim 1, wherein said channel has a length L, said pipe being arranged at 2 L/3.

19. Device according to claim 1, wherein said two volumes include a first main silencer and a second smaller silencer.

20. Device according to claim 1, wherein said two volumes include a filter housing and an inlet pipe.

* * * * *